US006247404B1

(12) United States Patent
Okamura

(10) Patent No.: US 6,247,404 B1
(45) Date of Patent: Jun. 19, 2001

(54) METHOD OF MAKING NEWSPAPER PRINTING PLATES

(75) Inventor: Yuichi Okamura, Toyonaka (JP)

(73) Assignee: Kabushiki Kaisha Kaneda Kikai Seisakusho, Osaka (JP)

( * ) Notice: Subject to any disclaimer, the term of this patent is extended or adjusted under 35 U.S.C. 154(b) by 0 days.

(21) Appl. No.: 09/432,052

(22) Filed: Nov. 1, 1999

(30) Foreign Application Priority Data

Nov. 2, 1998 (JP) ..... 10-311693

(51) Int. Cl.[7] ..... B41C 1/00

(52) U.S. Cl. ..... 101/401.1; 101/486; 101/DIG. 36

(58) Field of Search ..... 101/401.1, 463.1, 101/477, 485, 486, DIG. 36; 33/617, 620; 347/262, 264

(56) References Cited

U.S. PATENT DOCUMENTS

| | | | | |
|---|---|---|---|---|
| 4,259,904 | * | 4/1981 | Metje | 101/401.1 |
| 4,489,652 | * | 12/1984 | Takeuchi et al. | 101/DIG. 36 |
| 4,582,768 | * | 4/1986 | Takeuchi et al. | 101/DIG. 36 |
| 4,833,985 | * | 5/1989 | Kojima et al. | 101/401.1 |
| 4,846,036 | * | 7/1989 | Brown | 101/DIG. 36 |
| 4,846,059 | * | 7/1989 | Brown | 101/DIG. 36 |
| 4,872,407 | * | 10/1989 | Banke | 101/401.1 |
| 4,936,175 | * | 6/1990 | Clark | 101/DIG. 36 |
| 5,459,941 | * | 10/1995 | Lowe | 101/DIG. 36 |
| 5,511,479 | * | 4/1996 | Rogovein et al. | 101/486 |
| 5,537,927 | * | 7/1996 | Rogovein et al. | 101/485 |
| 5,850,789 | * | 12/1998 | Rudolf et al. | 101/486 |
| 5,913,267 | * | 6/1999 | Britsch | 101/401.1 |
| 6,076,464 | * | 6/2000 | Okamura | 101/401.1 |

* cited by examiner

*Primary Examiner*—Stephen R. Funk
(74) *Attorney, Agent, or Firm*—Griffin & Szipl, P.C.

(57) ABSTRACT

A method of making printing plates for color newspaper printing almost free from causing color dislocation. The present invention includes an exposure step 12 of directly drawing a desired image on a plate material E from a plate feeding step 11 by laser beam according to image drawing signals from a computer, a development and fixing step 13 of treating the exposed surface to produce a printing plate 5 with the desired image, and a bending and boring step 14 of forming bent edge stoppers 5*a*, 5*b* at the two edges of the printing plate 5 for mounting the plate 5 on the plate cylinder 4 and at least one positioning hole 5*c* for positioning the plate 5 on the plate cylinder 4. In the exposure step 12, pilot marks P in a desired shape are drawn near the two edges of the plate material E at the same time that a desired image T is drawn on the image drawing area Q of the plate material E according to image drawing signals from the computer. The bending and boring step 14 involves providing standard marks S having the same shape and the same positional relation as the pilot marks P above the printing plate loading table 7 of the bending and boring unit, automatically checking the superimposition between the pilot marks P on the printing plate 5 placed on the printing plate loading table 7 and the standard marks S by detection signals from an image sensor camera 19 provided above each standard mark S so that when the superimposition dislocation between the standard marks P on the printing plate 5 and the standard marks S is found to be under a set value level, at least one positioning hole 5*c* as well as bent edge stoppers 5*a*, 5*b* are formed at the two edges of the printing plate 5.

10 Claims, 9 Drawing Sheets

FIG. 5A
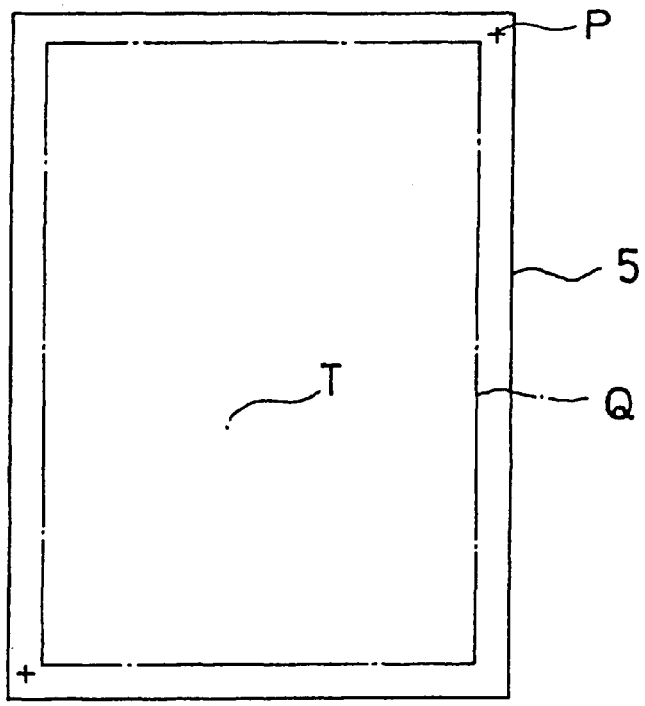
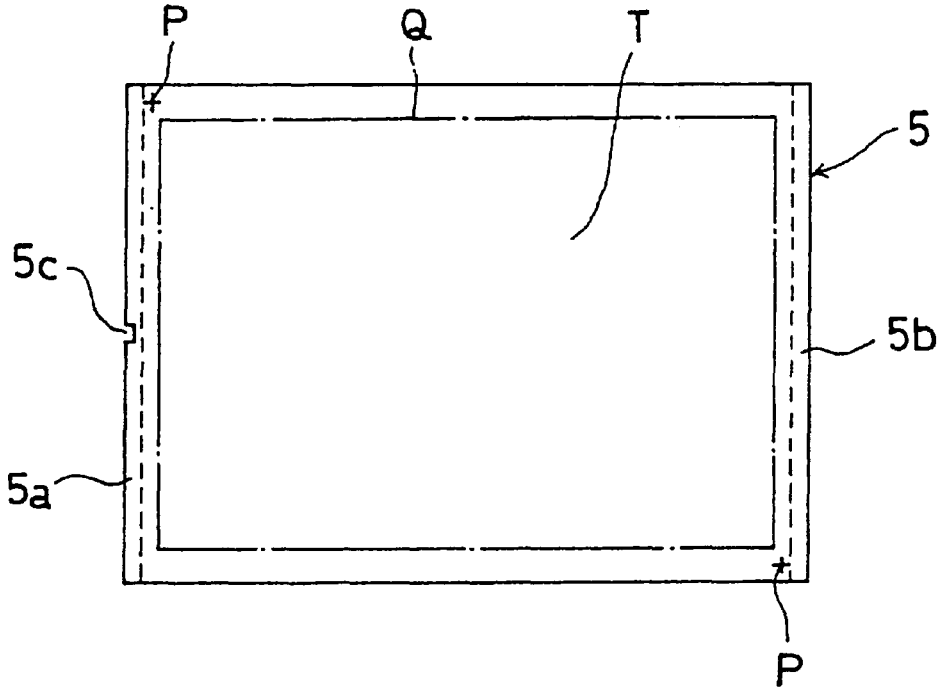
FIG. 5B

METHOD OF MAKING NEWSPAPER PRINTING PLATES

BACKGROUND OF THE INVENTION

1. Field of the Invention

The present invention relates to an improved method of making newspaper printing plates. More particularly, the present invention relates to a method of making newspaper printing plates which eliminates failure of exact image superimposition in color printing, through strict control of positional relation between the image formed on each plate in a set of four color printing plates and bent edge stoppers formed along two edges of the plate.

2. Description of the Prior Art

FIG. 8 shows an example of a prior art rotary press for newspaper printing, which works in this manner. Streams of paper 1 unwinding from paper rolls in paper feeders A, A, A are printed on both sides in monochromatic printer sections B, B, B and a color printer section Ba. Three streams of paper 1, put one on another, are then sent in to a folder section C where they are cut and folded into one sheet of newspaper one after another and sent out through a delivery fan D or the like.

The color printer section Ba includes a common or center printing cylinder 2 and four blanket cylinders 3 and four color plate cylinders 4. On the four color plate cylinders 4 are mounted printing plates 5 which have an identical image thereon and are for printing in four different colors, respectively—yellow, red, blue, and black (for glossing). Such prior art arrangements are disclosed, for example, in unexamined Japanese patent applications laid open under Nos. H08-267724 and H08-290543.

Most commonly, the printing plate 5 is mounted on the color plate cylinder 4 in the following manner. The forward and backward edges of the printing plate 5 are bent to form stoppers 5*a*, 5*b*, which are put in slits 4*a*, 4*a* provided on the plate cylinder 4 for holding the printing plate as shown in FIG. 9. The printing plate is closely wound around the plate cylinder 4 and held that way.

The printing plate 5 is wound around the plate cylinder 4 and held in position. That is usually effected in this manner. An axial positioning hole 5*c* is provided in one or both of the bent edge stoppers 5*a*, 5*b* at specific points. Into the hole 5*c* is inserted a positioning protrusion 4*b* provided on the plate cylinder 4 so that the axial-directional position of the printing plate 5 is held at a predetermined place.

FIGS. 10, 11, and 12 show a typical prior art apparatus for forming bent edge stoppers 5*a*, 5*b* on printing plate 5. The apparatus has a printing plate loading table 7 with an edge blade 6, a plate presser 8 vertically movable in relation to the printing plate loading table 7, a movable bending tool unit 9 including bending tools 9*a*, 9*b* and a vertically movable positioning pin unit 10 on each side—the front and rear sides of the printing plate loading table 7.

After the printing plate 5 is placed on the printing plate loading table 7, positioning pins 10*a* are inserted into positioning holes 5*d* provided at the forward and backward edges of the printing plate 5—the positioning holes 5*d* place the printing plate 5 in position on the printing plate loading table 7. The plate presser 8 is moved down to clamp the printing plate 5 as shown in FIG. 11. Then, the positioning pins 10*a* are moved back downward and the bending tool 9*a* of movable bending tool unit 9 is turned by a drive unit (not shown). In that way, the forward and backward edges of the printing plate 5 are bent along the edge line of the edge blades 6, 6 to form bent edge stoppers 5*a*, 5*b* as shown in FIG. 12. This technique is disclosed in Japanese utility model application No. S53-159703.

The prior art bent edge stopper forming apparatus shown in FIG. 10 can form bent edge stoppers in the printing plate 5 for monochromatic printing with great efficiency and has proved to be highly practical. But the color printing plates processed by the prior art apparatus have often failed in exact image superimposition, presenting a number of problems in practical application.

To prevent the failure in exact image superimposition in color printing, it is necessary to position a set of four printing plates—for yellow, red, blue, and black—on the four color plate cylinders so accurately that the four images overlap almost perfectly. That is, care has to be taken in forming the positioning holes 5*d* in the four printing plates 5 that place the printing plate 5 in position on the printing plate loading table 7 so that the positional relation between the image T on each printing plate and the positioning holes 5*d* may always be maintained uniformly.

That is also applicable to formation of bent edge stoppers 5*a*, 5*b* and the axial positioning hole 5*c* in the printing plate 5. The positional relation between the image T on all four printing plates and the bent edge stoppers 5*a*, 5*b* and the axial positioning hole 5*c* must be maintained to be the same.

In the prior art of making a printing plate for newspaper printing, the positions of the positioning holes 5*d* for positioning the plate 5 on the table 7 are decided upon on the basis of the dimensions of the printing plate, center of the printing plate, or the like. Positioning holes 5*d* are formed at the positions thus decided upon. In other words, the prior art method of making a printing plate for newspaper printing neither checks nor controls the positional relation between the image T formed on the printing face of the printing plate 5 and the positioning holes 5*d*.

Some adjustment is made in forming the image T on the printing face of the printing plate 5 so that the images T on the four printing plates may be placed at the same position. But it is visual adjustment that is used, which is inexact. No precision positioning is involved.

The result is that the four printing plates 5 that form a set of color printing plates tend to be slightly different from each other in regard to positional relation between the image T on the printing face and the positioning holes 5*d* to position the printing plate 5 on the printing plate loading table 7, bent edge stoppers 5*a*, 5*b*, and axial positioning hole 5*c*. Then, it is impossible to prevent failure of exact superimposition of the color printing faces no matter how precisely the four color plates were adjusted in mutual positional relation on a color plate cylinder in a color printer section B.

SUMMARY OF THE INVENTION

The present invention addresses the above-described problem with the prior art method of making printing plates for newspaper printing, that is, failure in exact image superimposition in color printing. This occurs because, in the prior art, when the four color printing plates are mounted on the color plate cylinders, the image T is not placed in the exactly identical position however carefully the positional relation is adjusted on the plate cylinders. The problem is that no strict controls are exercised on the positional relationships between: (1) an image T drawn on a printing face of a printing plate 5 and positioning holes 5*d* formed at the forward and backward edges of the printing plate 5 to put plate 5 in position on a printing plate loading table 7; (2) the image T and an axial positioning hole 5*c* to position the printing plate 5 on a plate cylinder 4 in the axial direction; and (3) the image T and bent edge stoppers 5*a*, 5*b* for mounting the printing plate 5 on the plate cylinder 4. It is, therefore, an object of the present invention to provide a method of making color printing plates for newspaper printing which makes it possible to consistently and economically prevent color images from getting deviated.

An object of the present invention is to provide a method of making printing plates for newspaper printing which method comprises an exposure step 12 of directly drawing a desired image T on a plate material E (in claim 2, from a plate feeding step 11) by laser beam in accordance with image drawing signals from a computer, a development and fixing step 13 of treating the exposed surface to produce a printing plate 5 with the desired image T, and a bending and boring step 14 of forming bent edge stoppers 5*a*, 5*b* at the forward and backward edges of the printing plate 5 for mounting the plate 5 on the plate cylinder 4 and forming at least one positioning hole 5*c* for positioning the plate 5 on the plate cylinder 4, wherein in the aforesaid exposure step 12 are drawn pilot marks P in a desired shape at the two edges of the plate material E at the time that the desired image T is drawn on the image drawing area Q of the sensitive plate E in accordance with image drawing signals from the computer and wherein the aforesaid bending and boring step 14 involves providing standard marks S having the same shape and the same positional relation between the marks as the aforesaid pilot marks P above the printing plate loading table 7 of the bending and boring unit, automatically checking—for any discrepancy in superimposition between the pilot mark P on the printing plate 5 placed on the printing plate loading table 7 and the standard mark S—by detection signals from an image sensor camera 19 provided above each standard mark S, so that when the superimposition discrepancy between the standard mark P on the printing plate 5 and the corresponding standard mark S is found to be under a set required value level, at least one positioning hole 5*c* as well as bent edge stoppers 5*a*, 5*b* are formed at the two edges of the printing plate 5.

A further object of the invention is to provide a method of making printing plates for newspaper printing as defined wherein the pilot marks P and the standard marks S are both cross marks.

The invention provides the method of making printing plates for newspaper printing as defined in claim 1 wherein the standard marks S are provided on transparent glass plates 17, 17 which are held above the printing plate loading table 7 and are movable in the directions of X, Y, Z axes.

The invention further provides the method of making printing plates for newspaper printing as defined in claim 1 wherein the standard marks S are movable on the transparent glass plates 17, 17 which are fixed or movable above the printing plate loading table 7 in the directions of X, Y, Z axes.

The invention also provides a method of making printing plates for newspaper printing wherein the standard marks S are provided below the image sensor cameras 19, 19 integrally therewith.

The invention provides a method of making printing plates for newspaper printing, wherein it is so arranged that the detection signals S' for the standard mark S from the image sensor camera 19 and the detection signals SP' received from the image sensor camera 19 when the standard mark S and the pilot mark P are superimposed are compared by computer G and that the printing plate loading table 7 with a printing plate 5 fixed thereon is moved and adjusted to reduce the difference between two signals S' and SP'.

The invention provides a method of making printing plates for newspaper printing wherein the printing plate loading table 7 is movable in the directions of X, Y, and Z axes and allowed to turn and wherein the superimposition between the pilot mark P on the printing plate 5 and the standard mark S is adjusted by moving and regulating the printing plate loading table 7 with a printing plate 5 fixed thereon.

The invention provides a method of making printing plates for newspaper printing wherein it is so arranged that the detection signals S' for the standard mark S from the image sensor camera 19 and the detection signals SP' received from the image sensor camera 19 when the standard mark S and the pilot mark P are superimposed are compared by computer G and that the printing plate loading table 7 with a printing plate 5 fixed thereon is moved and adjusted to reduce the difference between two signals S' and SP'.

BRIEF DESCRIPTION OF THE DRAWINGS

FIGS. 5A and 5B illustrate rotation of the printing plate 5 from a first position (FIG. 5A) to a second position (FIG. 5B) before being sent to the bending and boring step.

DESCRIPTION OF PREFERRED EMBODIMENTS

Figure 1:
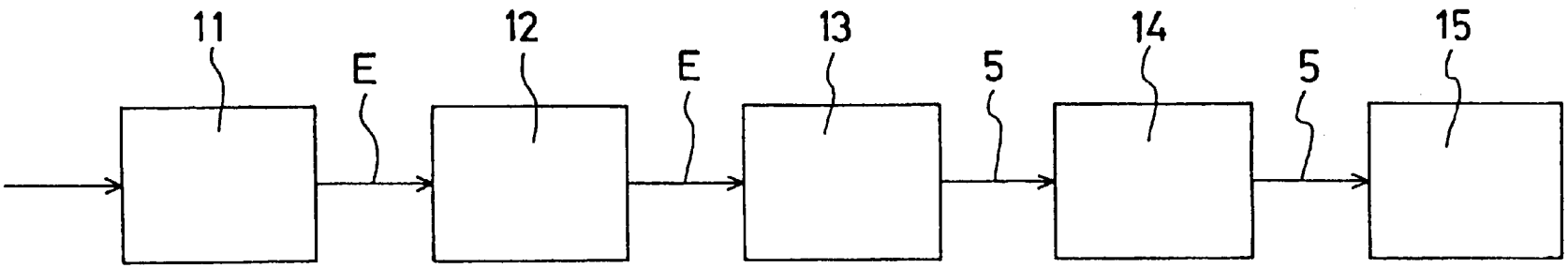
FIG. 1 (PRIOR ART)
FIG. 1 is a flow chart showing the process of making printing plates for newspaper printing.

FIG. 1 is a flow chart showing the process of making printing plates according to the present invention. In FIG. 1, the numeral 11 indicates the plate feeding step, 12 the exposure step (image drawing step), 13 the development and fixing step, 14 the bending and boring step, and 15 the printing plate stacker section. The plate material E from the plate feeding step 11 is sent to the exposure step 12 where a desired image is drawn on the plate E by the so-called computer to plate (CTP) technique. In the CTP technique, a laser scanning head is actuated and controlled by the image drawing signals from the computer.

After the desired image is drawn, the plate material E is referred to the development and fixing step 13 where the plate E is subjected to heating, development, rinsing, rubber coating, and drying before a printing plate 5 for newspaper printing is obtained. From the development and fixing step 13, the printing plate 5 is sent to the bending and boring step 14. In this step, the printing plate 5 is bent at the forward and backward edges (to form bent edge stoppers 5*a*, 5*b*) and is bored at one or both of the bent edge stoppers 5*a*, 5*b* to form an axial positioning hole Sc that determines the axial position of the printing plate 5 on the plate cylinder.

The finished printing plate 5 is stored in the stacker section 15 as it is sent out of the bending and boring step 14.

The system of making printing plates for newspaper printing as shown in FIG. 1 is known. Details of the system are disclosed in patent applications filed by the inventors of the present invention and laid open unexamined under Nos. H09-66595 and H10-142805.

Figure 2:
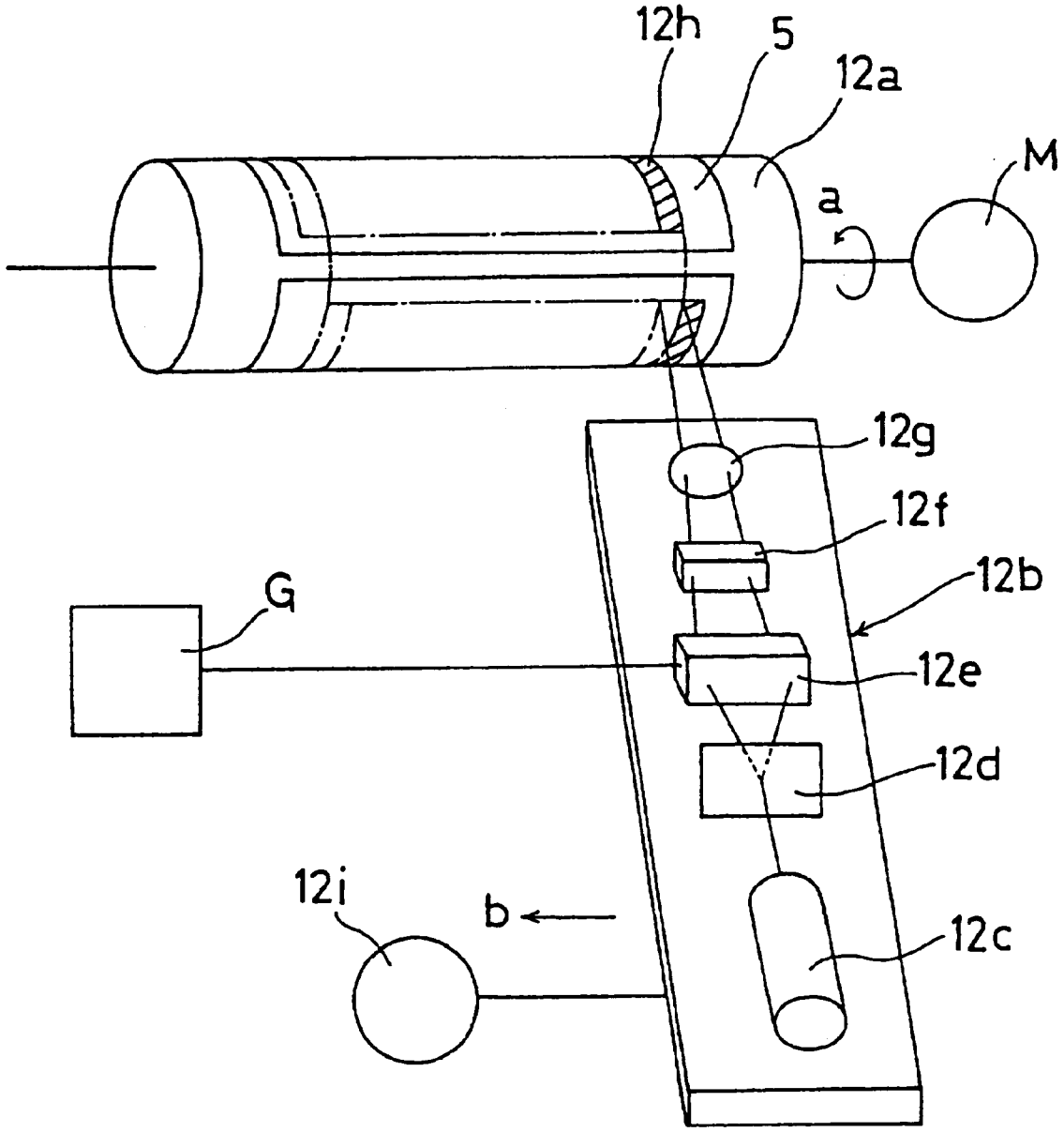
FIG. 2 (PRIOR ART)
FIG. 2 is a diagrammatic illustration of a typical drum-type printing plate exposure unit used in the present invention.

FIG. 2 shows a drum-type printing plate exposure apparatus used in the exposure step 12 in the present invention. This is disclosed in a patent application laid open unexamined under No. H10-142805 and others. To further illustrate, a printing plate 5 such as a presensitized (PS) plate, that is, a thin substrate coated with a photosensitive material is wound around the outer circumferential surface of a drum 12*a* which is turned by a motor M in the direction of arrow a.

The apparatus is equipped with an optical table 12*b* on which are provided a variety of optical apparatuses. A laser beam emitted from a laser source 12*c* like a semiconductor laser is split into a multi-beam by a multi-beam generating element 12*d* such as a grating or Wollaston prism. The multi-beam passes through an audio-optical modulator (AOM) 12*e* which is switch-controlled by image signals from computer G, an exposure unit 12*f* comprising a light source array made up of optical fibers, and a lens 12*g* before reaching printing plate 5. This light source array 12*f* is a typical exposure unit to record images directly on the printing plate 5. In recording an image on the printing plate 5, exposure produces an image band 12*h* with a band width H which corresponds to the irradiation width of the multi-beam. The moving mechanism 12*i* moves the optical table 12*b* continuously at a fixed rate in the direction of arrow b by a distance of the band width H while the drum 12*a* makes one revolution.

In the present invention, the aforesaid exposure step 12 is to draw pilot marks P for image matching (which will be described below) as well as the desired image T on the printing plate 5 by CTP technique. The desired image T includes ordinary newspaper articles, diagrams, and photos.

The aforesaid pilot marks P are drawn at two places along with the desired image T—with each mark P apart a specific distance from one of the two opposing corners of a preset quadrangular image drawing area Q in the printing plate 5—by laser beam controlled by the image signals from the computer. As a result, the positional relation between the image drawing area Q or the image T drawn within the area Q and the pilot marks P is always maintained to be equal. This means that a set of four color printing plates 5 all have a perfectly identical positional relation between the pilot marks P and the image drawing area Q or the image T, as shown in FIG. 3.

In the present embodiment, the exposure step 12 is performed using the CTP method drum-type exposure unit. Alternatively, the exposure unit 12 may be of the plane-type as long as a CTP method is adopted.

Figure 3:
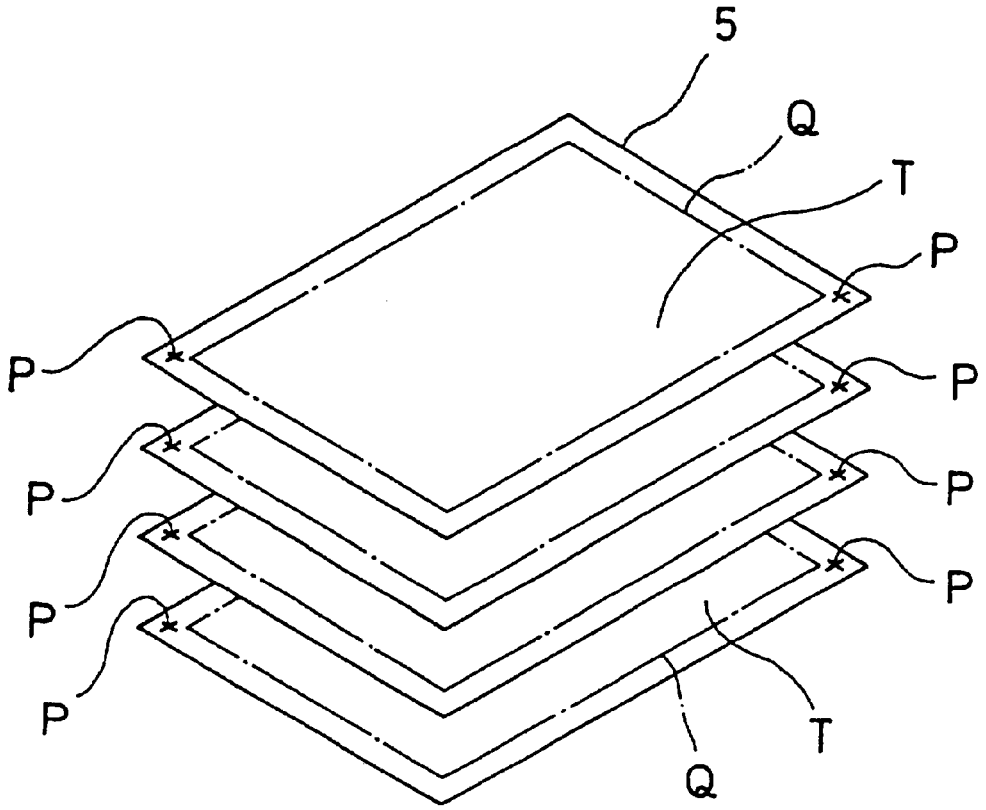
FIG. 3 is a diagrammatic illustration showing the positional relation between the pilot marks formed on the color printing plates and the image drawing area.

In the present embodiment, the pilot marks P formed on the printing plate 5 are a cross as shown in FIG. 3. Needless to say, that is not restrictive. The pilot mark P may be in any shape.

Figure 4:
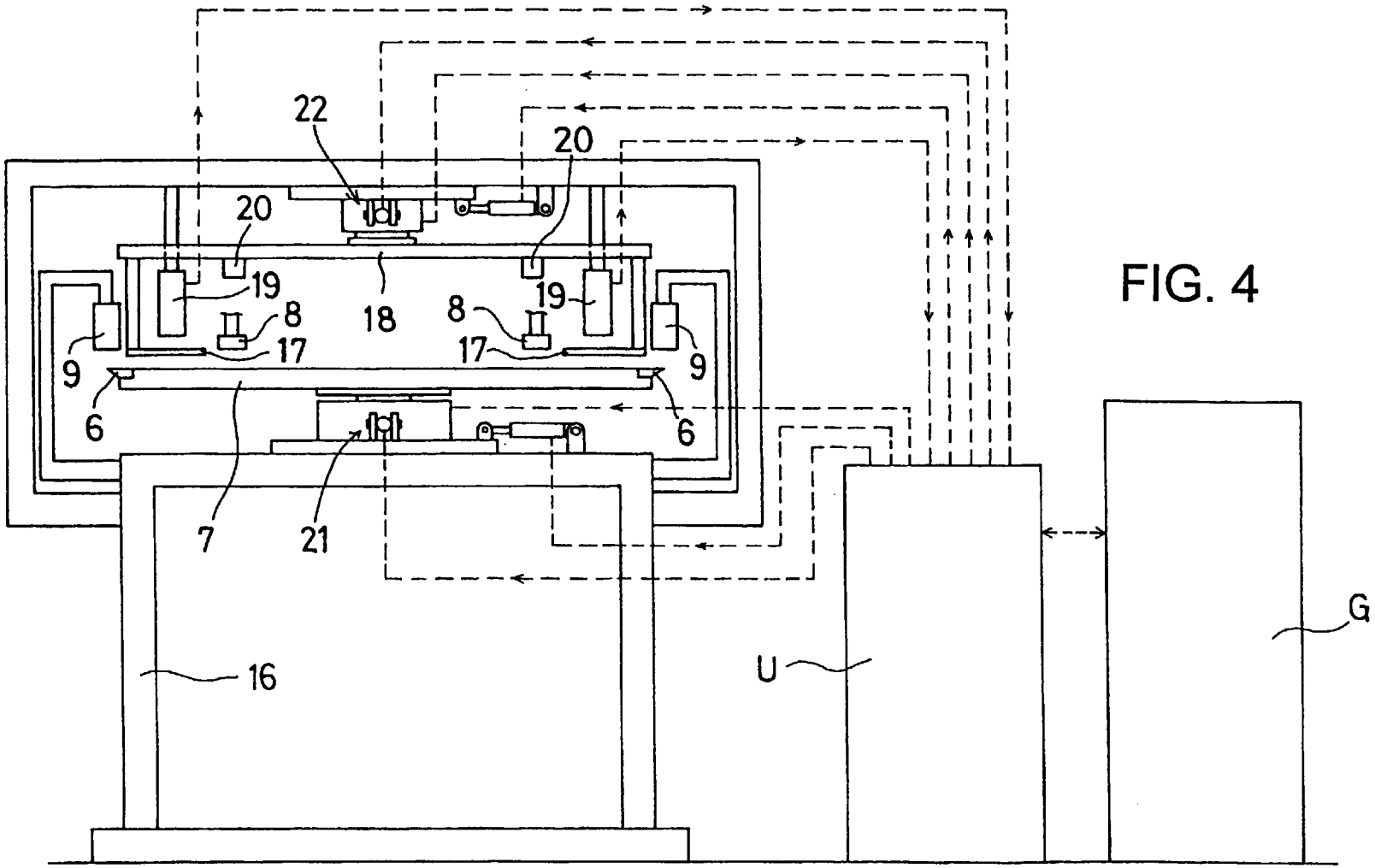
FIG. 4 is a schematic sectional view of a typical bending and boring unit used in the present invention.

FIG. 4 gives an outline of the bending and boring unit used in the bending and boring step 14 which constitutes the core of the present invention.

The bending and boring unit includes a frame 16, a printing plate loading table 7 mounted horizontally on the frame 16, and rotatable and position-adjustable in X, Y, and Z axes, bending edge blades 6, 6 provided at the two opposite ends of the printing plate loading table 7, movable bending tool units 9, 9 fixed on and mounted above the two opposed ends of the printing plate loading table 7, plate pressers 8, 8 provided above the printing plate loading table 7 and movable up and down, glass plates 17, 17 provided horizontally just above the two opposed ends of the printing plate loading table 7 to bear the standard marks S, a glass plate holder 18 to hold the glass plates 17, 17 such that the glass plates are rotatable and movable in X, Y, and Z axes, image sensor cameras 19, 19 provided above, and opposite to, the standard marks S on the glass plates 17, 17, a controller U that receives sensor signals from the image sensor cameras 19, 19 and judges the setting accuracy of printing plate 5 by checking for discrepancy in superimposition between the pilot marks P on the printing surface of the plate 5 and the standard marks S, a computer G to control the operation of the controller U and the working of the printing plate loading table 7, a glass plate holder 18, and movable bending tool units 9*a*, 9*b* for bending, etc.

The bending and boring unit is provided with punching mechanisms (not shown) that make axial positioning holes 5*c* at specific points of the forward and backward edges of printing plate 5. The axial positioning holes 5*c* are to determine the axial position of the plate 5 when the plate 5 is mounted on the plate cylinder 4.

In FIG. 4, the numeral 20 indicates a halogen light source for the image sensor camera 19, the numeral 21 a drive unit for the printing plate loading table 7 and the numeral 22 a drive unit for the glass plate holder 18.

There will now be explained about the formation of bent edge stoppers 5*a*, 5*b* at the edges of the printing plate 5 and axial positioning holes 5*c* using the bending and boring unit.

In the exposure step 12, the image T and pilot marks P on the printing plate 5 are exposed by the CTP technique. The exposed image T and pilot marks P are treated at the development and fixing step 13 to produce a printing plate 5 for newspaper printing. For color printing, a set of printing plates 5 is prepared. One set consists of four printing plates—for yellow, red, blue and black—which have all the same image T and pilot marks P. That is, the four plates are all identical not only in the shape of the image T and pilot marks P but also in positional relation between the image T and the pilot marks P.

In the next step or the bending and boring step 14, the holder 18 of the glass plates 17, 17—the glass plates bearing the standard marks S which have the same shape as the pilot marks P and the same positional relation between the marks as the pilot marks P on the printing plate 5—is first adjusted in position so that the images of the standard marks S may be detected with high precision by the image sensors camera 19, 19. Then, the position adjusted holder 18 of the glass plates 17, 17 is immovably fixed. Next, the image signals for the standard marks S are detected by the image sensor cameras 19, 19 and input into the memory of the control computer G through the controller U. The image sensor cameras 19, 19 used in the present embodiment are ones using a so-called charge coupled device (CCD).

In the present embodiment, the standard marks S (glass plate holder 18) are adjusted, with the image sensor cameras 19, 19 fixed. That may be reversed to adjust the positional relation therebetween.

It is noted that the glass plate holder 18 and the image sensor cameras 19, 19 are both so provided on the frame 16 so that the holder 18 and the cameras 19 are adjustable in position. But after they have been adjusted in position, they are fixed on the frame 16.

It is desirable to so arrange the apparatus that the glass plates 17, 17 bearing the standard marks S can be replaced with other glass plates with new (that is, different) standard marks S corresponding to the pilot marks P on a new (different) plate 5. This is useful in situations where, for instance, relative positions of the pilot marks P have changed as a result of a change of type of the plate necessitated by, for instance, a change of kind of the rotary press.

Alternatively or at the same time, it is possible to so configure the apparatus that the standard marks S provided on the glass plates 17, 17 can be moved or changed in position, to cope with situations where, for instance, the relative position of the pilot marks P must be altered because the kind of printing plate is changed.

The flat printing plate 5 coming out of the development and fixing step 13 is turned 90 degrees on the level plane counter-clock-wise, as shown in FIGS. 5A and 5B, just before entering the bending and boring unit. The printing plate 5 is then inserted between the glass plate holder 18 and the printing plate loading table 7 in the bending and boring unit and placed at a predetermined position on the printing plate loading table 7. The predetermined position is a position in which the two pilot marks P on the printing plate 5 come roughly right under the standard marks S on the glass plates 17.

When the printing plate 5 is placed in position on the printing plate loading table 7, the plate presser 8 is first lowered to clamp the printing plate 5 on the printing plate loading table 7. Then, the image sensor cameras 19, 19 are actuated to detect the superimposition of the standard marks S and the pilot marks P, and the detection signals are input in the computer G through the controller U. The computer G compares the detection signals S' only for the standard marks S on the glass plates 17, 17 detected in advance by the image sensor cameras 19, 19, with the detection signal SP' obtained later with the standard marks S superimposed on the pilot marks P.

Figure 6:
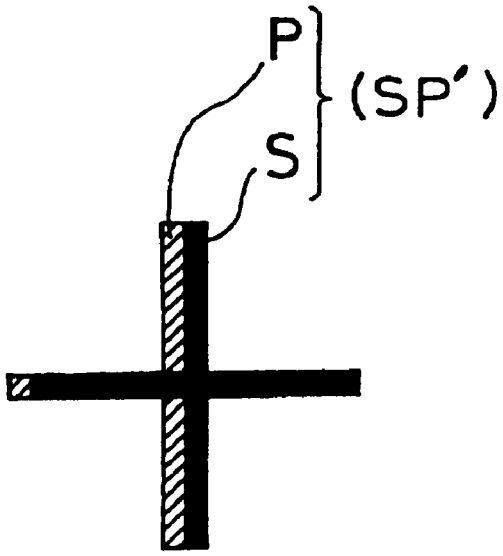
FIG. 6 shows a typical camera image of the printing plates that are slid sideways.
Figure 7:
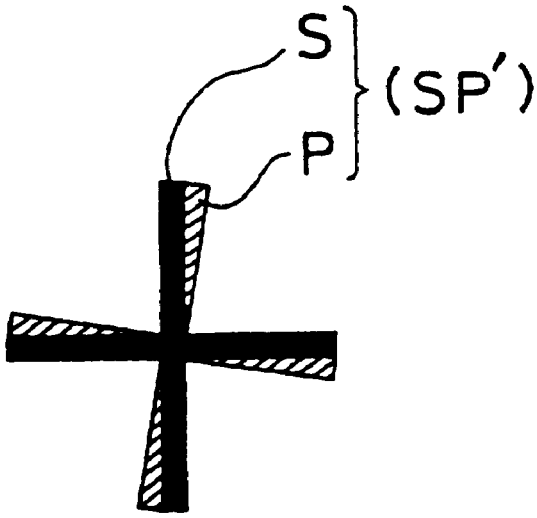
FIG. 7 shows a typical camera image of the printing plates that are twisted.
Figure 8:
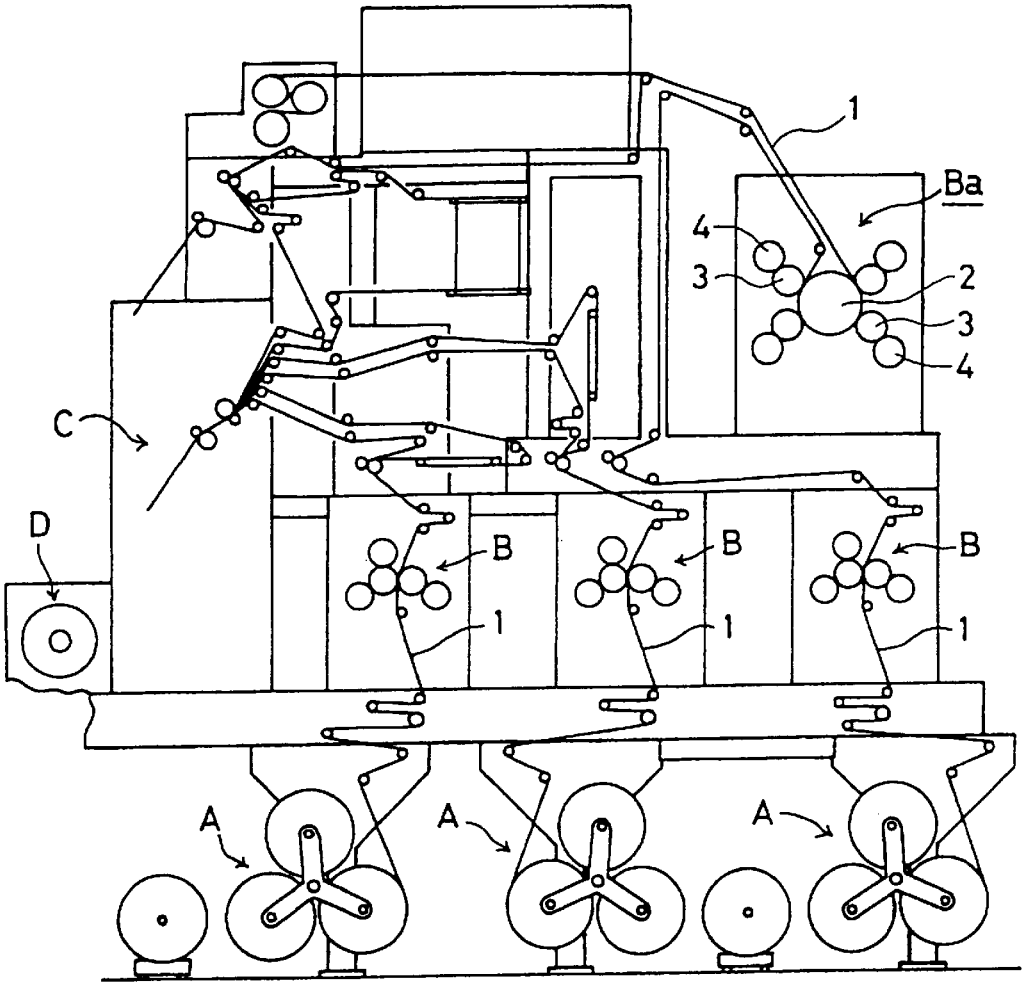
FIG. 8 (PRIOR ART)
FIG. 8 is a schematic side view showing a typical prior art rotary press for newspaper printing.
Figure 9:
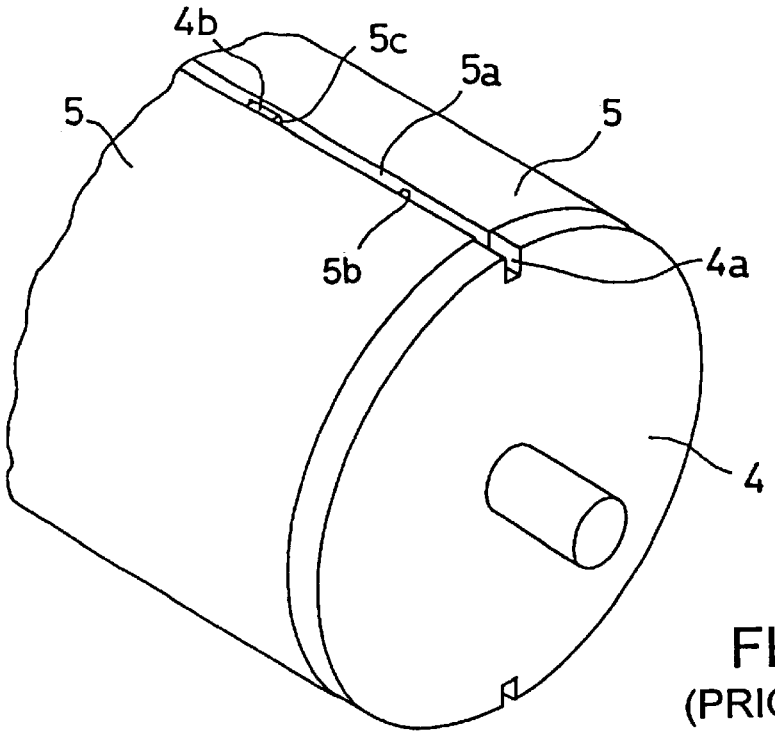
FIG. 9 (PRIOR ART)
FIG. 9 is a diagrammatic illustration showing a printing plate mounted on the plate cylinder.
Figure 10:
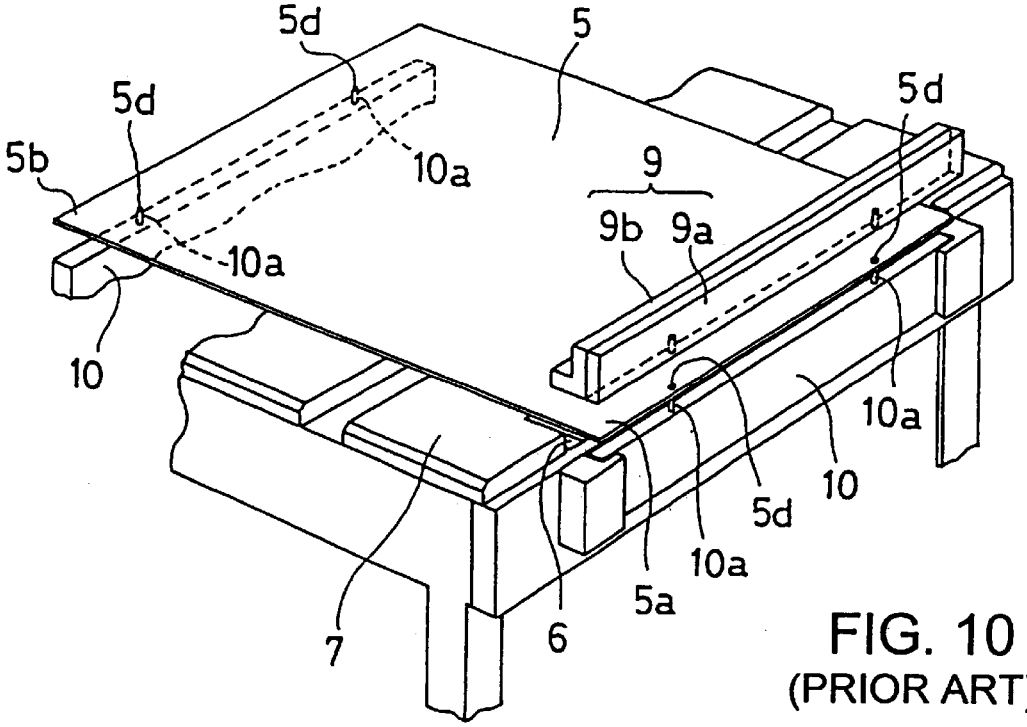
FIG. 10 (PRIOR ART)
FIG. 10 is a perspective view showing a typical prior art apparatus for forming bent edge stoppers 5*a*, 5*b* on the edges of the printing plate 5.
Figure 11:
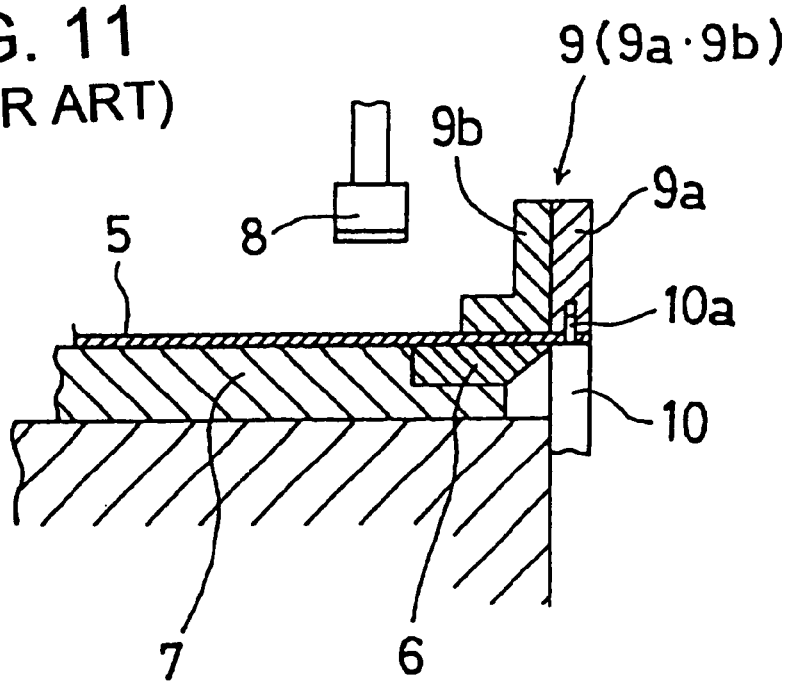
FIG. 11 (PRIOR ART)
FIG. 11 is a diagrammatic illustration showing the step of forming the bent edge stopper 5*a*.
Figure 12:
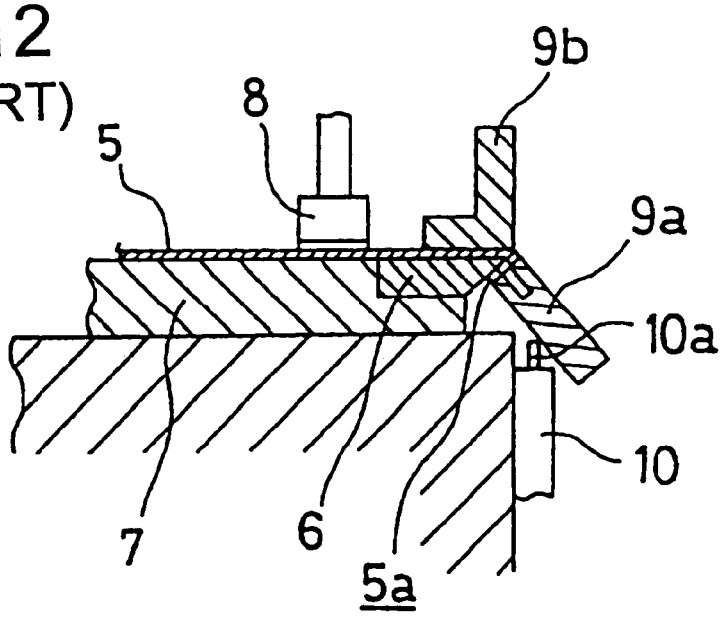
FIG. 12 (PRIOR ART)
FIG. 12 is another diagrammatic illustration showing the step of forming the bent edge stopper 5*a*.

If the superimposed images of the two marks S, P observed by the image sensor camera 19 is as in FIG. 6 in which one is deviated from the other in either the X or Y axis direction or as FIG. 7 in which the printing plate 5 is twisted, then the difference between the two detection signals S', SP' is great, exceeding a preset standard level.

In case the difference between the two detection signals S', SP' is greater than the standard level, the drive unit 21 under the printing plate loading table 7 is actuated by actuating signals from the controller U, and the printing plate loading table 7 will be moved until the difference (S'−SP') between the two detection signals S', SP' becomes almost zero. Where the difference between the two detection signals is reduced to almost zero or under the preset required level, then the printing plate loading table 7 is fixed. In that way, the printing plate loading table 7 with the printing plate 5 fixed thereon is adjusted in position.

When the two pilot marks P on the printing plate 5 are superimposed almost perfectly in the vertical direction on the two standard marks S on the glass plate 17, that is, the difference (S'−SP') between the two detection signals S', SP' is under the required level, the printing plate loading table 7 is first fixed. Then a boring mechanism (not shown) is actuated to make one or more axial positioning holes 5*c* on one or both of the right and left sides of the printing plate 5.

Next, the movable bending tool unit 9 is actuated to bend the two ends of the printing plate 5 downward on the edge blade 6. Thus bent edge stoppers 5*a*, 5*b* are formed.

This step makes the printing plate 5 ready for placement on the plate cylinder 4. The finished printing plate 5 is sent to the plate stacker section 15 to be stored.

It is noted that for color printing, four printing plates 5 with the identical image T, pilot marks P, bent edge stoppers 5*a*, 5*b*, and axial positioning hole 5*c* constitute one set.

In the embodiment shown in FIG. 4, comparatively large glass plates 17, 17 are held by the glass plate holder 18. Instead, very small glass plates 17, 17 may be used and provided with a standard mark S if a sufficient parallelism with respect to the printing plate loading table 7 can be secured.

The standard mark S may be installed integrally in the image sensor camera 19 as in a filter lens. In that case, either of the following arrangements may be used: The printing plate loading table 7 is adjusted in position in relation to the image sensor camera 19 fixed in a specific position. Or, the image sensor camera 19 is adjusted in position in relation to the printing plate loading table 7 fixed in a specific position.

In the preceding description, the position of the printing plate loading table 7 is adjusted so as to bring to zero the difference between detection signals S' for the standard marks S and the detection signals SP' obtained with the standard marks S superimposed on the pilot marks P. In practice, however, if the difference between the two signals is under a preset required level, it is judged that the four printing plates 5 are sufficiently superimposed (enough to avoid color deviation in printing). The preset level is decided on from experience in the light of the sharpness required in images.

According to the present invention, an image T is exposed on the printing plate 5 by the CTP technique in exposure step 12. At the same time, the pilot marks P are drawn at specific places on the printing plate 5. Therefore, it is possible to produce a great number of printing plates 5 without difficulty in which the image T and the pilot mark P are identical in size and the positional relationship between the two marks is the same.

In the present invention, it is also noted, standard marks S identical with the pilot marks P on the printing plate 5 in shape and positional relation are provided above the printing plate loading table 7 of the bending and boring unit. And it is so arranged that the image sensor cameras 19, 19 automatically check the superimposition of the pilot marks P on the printing plate 5 loaded on the printing plate loading table 7 and the standard marks S above the same. On the basis of the detection results, the superimposition of the two marks P, S is almost perfectly tuned. Then, bent edge stoppers 5*a*, 5*b* and axial positioning holes 5*c* are formed at the edges of the printing plate 5. That produces the printing plates 5 that are all perfectly identical in positional relation between the image T and bent edge stoppers 5*a*, 5*b* and axial positioning holes 5*c* and also in the formation of bent edge stoppers 5*a*, 5*b*.

As set forth above, the printing plates for color printing processed according to the present invention are kept strictly uniform in all corresponding respects among the different colors. With these printing plates mounted on the plate cylinders of a rotary press, therefore, failure in image superimposition in color printing can be definitely prevented. With proper adjustment in phase among the plate cylinders, it is possible to solve this problem. Thus, the present invention works very well in practice.

What is claimed is:

1. A method of making printing plates for newspaper printing which comprises the steps of: directly drawing a desired image on a plate material by laser beam according to image drawing signals from a computer, in an exposure step; treating the exposed surface to produce a printing plate with a desired image, in a development and fixing step; and forming bent edge stoppers, at the forward and backward edges of the printing plate for mounting the plate on a plate cylinder and forming at least one positioning hole for positioning the plate on the plate cylinder, in a bending and boring step, wherein, in said exposure step, pilot marks are drawn in a desired shape at the two edges of the plate material at the time when the desired image is drawn on an image drawing area of the plate material according to the image drawing signals from the computer, and wherein said bending and boring step comprises providing standard marks having the same shape and the same positional relation as said pilot marks above a printing plate loading table of a bending and boring unit, and automatically checking for discrepancy in superimposition between the pilot mark on the printing plate placed on the printing plate loading table and the standard mark by detection signals from an image sensor camera provided above each standard mark, so that when the superimposition discrepancy between the standard mark on the printing plate and the standard mark is found to be under a set required value level, at least one positioning hole as well as said bent edge stoppers are formed at the two edges of the printing plate.

2. The method of making printing plates for newspaper printing as defined in claim 1, wherein the plate material is supplied by a plate feeding step.

3. The method of making printing plates for newspaper printing as defined in claim 1, wherein the pilot marks and the standard marks are both cross marks.

4. The method of making printing plates for newspaper printing as defined in claim 1, wherein the standard marks are provided on transparent glass plates which are held above the printing plate loading table and which are movable in the directions of X, Y, Z axes.

5. The method of making printing plates for newspaper printing as defined in claim 1, wherein the standard marks are movable on transparent glass plates, the transparent glass plates being movable in the directions of X, Y, Z axes above the printing plate loading table.

6. The method of making printing plates for newspaper printing as defined in claim 1, wherein the standard marks are provided below the image sensor camera integrally therewith.

7. The method of making printing plates for newspaper printing as defined in claim 1, wherein the image sensor camera produces detection signals S' for the standard marks and detection signals SP' when the standard marks and the pilot marks are superimposed, the signals S' and SP' are compared by a computer, and the printing plate loading table with a printing plate fixed thereon is moved and adjusted to reduce the difference between said signals S' SP'.

8. The method of making printing plates for newspaper printing as defined in claim 1, wherein the printing plate loading table is movable in the directions of X, Y, and Z axes and is allowed to turn and wherein the superimposition between the pilot mark on the printing plate and the standard marks is adjusted by moving and regulating the printing plate loading table with a printing plate fixed thereon.

9. The method of making printing plates for newspaper printing as defined in claim 8, wherein the image sensor camera produces detection signals S' for the standard marks and detection signals SP' when the standard marks and the pilot marks are superimposed, the signals S' and SP' are compared by a computer, and the printing plate loading table with a printing plate fixed thereon is moved and adjusted to reduce the difference between said signals S' and SP'.

10. The method of making printing plates for newspaper printing as defined in claim 1, wherein the standard marks are movable on transparent plates, the transparent glass plates being fixed in position above the printing plate loading table.

* * * * *